US010344671B2

(12) United States Patent
Collins et al.

(10) Patent No.: US 10,344,671 B2
(45) Date of Patent: Jul. 9, 2019

(54) HELICAL FOLLOWER INTERNAL COMBUSTION ENGINE

(71) Applicants: Evan John Collins, Ann Arbor, MI (US); John Michael Richardson, Owosso, MI (US)

(72) Inventors: Evan John Collins, Ann Arbor, MI (US); John Michael Richardson, Owosso, MI (US)

( * ) Notice: Subject to any disclaimer, the term of this patent is extended or adjusted under 35 U.S.C. 154(b) by 498 days.

(21) Appl. No.: 15/237,513

(22) Filed: Aug. 15, 2016

(65) Prior Publication Data

US 2018/0045112 A1 Feb. 15, 2018

(51) Int. Cl.

| | |
|---|---|
| ***F02B 25/00*** | (2006.01) |
| ***F02B 75/32*** | (2006.01) |
| ***F01L 1/14*** | (2006.01) |
| ***F01L 1/02*** | (2006.01) |
| ***F01L 1/053*** | (2006.01) |
| ***F01B 3/04*** | (2006.01) |
| ***F01B 3/10*** | (2006.01) |
| ***F02B 75/26*** | (2006.01) |
| *F02B 75/02* | (2006.01) |
| *F01L 1/047* | (2006.01) |

(52) U.S. Cl.

CPC ..... *F02B 75/32* (2013.01); *F01B 3/04* (2013.01); *F01B 3/101* (2013.01); *F01L 1/026* (2013.01); *F01L 1/0532* (2013.01); *F01L 1/14* (2013.01); *F02B 75/26* (2013.01); *F01L 1/143* (2013.01); *F01L 2001/0476* (2013.01); *F02B 2075/025* (2013.01); *F02B 2075/027* (2013.01)

(58) Field of Classification Search

CPC ..... F02B 75/32; F02B 75/26; F02B 63/041; F01B 3/04; F01B 9/06; F01B 3/06; F04B 9/047; H02K 35/02; H02K 35/04

USPC ..... 123/56.1–56.9, 3, 65 R, 45 R, 197.1; 290/1 A, 1 R

See application file for complete search history.

(56) References Cited

U.S. PATENT DOCUMENTS

| | | | | |
|---|---|---|---|---|
| 1,572,068 A * | 2/1926 | Gould | F01B 3/04 | 123/43 AA |
| 4,511,805 A * | 4/1985 | Boy-Marcotte | F02G 1/0435 | 290/1 R |
| 4,532,431 A * | 7/1985 | Iliev | F02B 63/04 | 123/46 E |
| 5,442,913 A * | 8/1995 | Cho | F02G 1/043 | 60/518 |

(Continued)

*Primary Examiner* — Marguerite J McMahon
*Assistant Examiner* — James J Kim
(74) *Attorney, Agent, or Firm* — Heed Law Group PLLC; Thomas P. Heed

(57) ABSTRACT

The present invention is helical follower internal combustion engine. The present invention has a smooth, cylindrical follower orthogonally attached to a piston rod. The follower fits into two connected half-cylindrical, helical grooves formed by a two-piece cylindrical sleeve. The two-piece cylindrical sleeve is attached to a rotating cylindrical hub. Reciprocal motion of the piston causes rotation of the rotating cylindrical hub. The present invention has a feature that prevents the piston from rotating. The present invention can create electricity by connecting a rotor coil to the rotating cylindrical hub and placing a stator coil in near proximity. In an alternative embodiment, the present invention has an external drive shaft attached to the rotating cylindrical hub.

32 Claims, 9 Drawing Sheets

(56) References Cited

U.S. PATENT DOCUMENTS

| | | | | |
|---|---|---|---|---|
| 5,936,320 | A * | 8/1999 | Takeda | F02B 63/04 310/216.052 |
| 6,349,683 | B1 * | 2/2002 | Annen | F02B 63/04 123/46 E |
| 6,876,113 | B1 * | 4/2005 | Harris | F02B 63/04 123/3 |
| 7,856,714 | B2 * | 12/2010 | Hyde | B60K 6/24 123/149 R |
| 8,171,812 | B2 * | 5/2012 | Raether | F01B 3/0079 74/25 |
| 2003/0074897 | A1 * | 4/2003 | Rollston | F01B 3/0023 60/517 |
| 2011/0011368 | A1 * | 1/2011 | Raether | F01B 3/0079 123/197.4 |

* cited by examiner

HELICAL FOLLOWER INTERNAL COMBUSTION ENGINE

FIELD OF INVENTION

This invention relates to the classification of power plants, and to one or more sub-classifications under internal combustion engines. Specifically, this invention is an internal combustion engine with direct rotation of the drive shaft.

BACKGROUND OF INVENTION

An internal combustion engine burns fuel inside a confined space called a combustion chamber. This exothermic reaction of a fuel with an oxidizer creates gases of high temperature and pressure, which are permitted to expand. An internal combustion engine allows the expanding hot gases to work directly on a piston, moving the piston. An internal combustion engine can be contrasted with an external combustion engine. An external combustion engine, such as a steam engine, uses combustion to heat a separate working fluid, such as water or steam. The working fluid then performs work on the piston.

The most common type of internal combustion engine is a reciprocating engine, such as a two-stroke, four-stroke, or diesel engine. The first practical four-stroke engine was developed by Nikolaus Otto working with Gottlieb Daimler and Wilhelm Maybach in 1876. The first practical two-stroke engine was developed three years later by Karl Benz. The reciprocating internal combustion engine has come to dominate the ground transportation, such as cars and trucks.

In a reciprocating internal combustion engine, the combustion is intermittent, rather than continuous. The reciprocating internal combustion engine converts its reciprocating motion into rotational motion using a crankshaft that is connected to the pistons with a plurality of connecting rods. Typically, to get the rotational motion to the drive shaft, it goes through a transmission.

Reciprocating internal combustion engines lose significant amounts of energy, and therefore efficiency, through frictional losses. The crankshaft and connecting rod assemblies are complex and add significantly to the frictional losses, size of the engine, and weight of the engine. In applications that are using rotational energy to produce electricity, reciprocating internal combustion engines are inefficient, although sometimes utilized for lack of reasonable alternatives. Reciprocating internal combustion engines are also difficult to package in many applications, due to their size and weight.

There is a market for a small internal combustion engine that is lighter, simpler, and more efficient than traditional two-stroke and four-stroke engines. In fact, there is a good argument that the lack of such an engine inhibits certain markets such as portable power tools and drones. Such a lightweight, simple, and efficient internal combustion engine would have to solve the problem of translating reciprocal motion into rotational motion in a more efficient manner.

PRIOR ART REVIEW

There is clearly a market demand for a lighter, simpler, and more efficient internal combustion engine, one that has a better method of translating reciprocal energy into rotational energy. The recent prior art only showed a single example of trying to convert reciprocal motion to rotational motion without an intermediate crankshaft with connecting rods. U.S. Utility Pat. No. 5,203,295, by named inventor Alexander, entitled, "Internal combustion engine" ("Alexander '295"), discloses the use of ball bearings embedded in a piston rod, which is mated with a rotating shaft during the power stroke, via a one-way clutch. The driven shaft has a helical groove that is engaged by the bearing during the power stroke. Although Alexander '295 dispenses with the connecting rod and crankshaft, it adds a one-way clutch and a cumbersome mating system.

The prior art also teaches other applications of helical structures used in conjunction with internal combustion engines. For example, U.S. Utility Pat. No. 5,482,011, by named inventor Falck, entitled, "Four-cycle internal combustion engine having a rotating cylinder sleeve" ("Falck '011") teaches using a helical blade as part of a scheme to rotate a cylinder sleeve. The cylinder sleeve has an opening that rotates in sequence with a four stroke engine, lining up with the ports at the correct time. U.S. Utility Pat. No. 4,693,218, by named inventor Nakagura, entitled, "Internal combustion engine" ("Nakagura '218") teaches using a helical groove in combustion chamber. U.S. Utility Pat. No. 4,592,309, by named inventor Williams, entitled, "Internal combustion engine" ("Williams '309") teaches using a helical ramp to vary the volume of the combustion chamber.

None of the prior art teaches a lightweight, simple, and efficient internal combustion engine that translates reciprocal motion into rotational motion in a more efficient manner than traditional four-stroke engines.

SUMMARY OF THE INVENTION

This summary is intended to disclose the present invention, a Helical Follower Internal Combustion Engine. The present invention relates to using the reciprocal motion of an internal combustion engine to rotate a drive shaft without the use of connecting rods, intermediate crankshaft, or transmission.

The external surface of the Helical Follower Internal Combustion Engine comprises a valve cap, cylinder head, housing, rear cover, access nut, access port, and intake hole or manifold mount.

Internal to the housing, the Helical Follower Internal Combustion Engine uses a two-piece cylindrical sleeve that is bolted directly to the rotating cylindrical hub that acts as a drive shaft. The two-piece cylindrical sleeve forms two half-cylindrical, helical grooves. There is an upper piece of the cylindrical sleeve and a lower piece of the cylindrical sleeve. A protrusion, called a follower, extends from the piston rod, fitting in the two half-cylindrical, helical grooves. The two half-cylindrical, helical grooves mirror one another, three-dimensionally, down a defined centerline of the two-piece cylinder sleeve.

The Helical Follower Internal Combustion Engine has a piston with a piston head and a piston rod. The piston head fits inside a piston sleeve, which itself, fits inside a cylindrical housing. A cylinder head mates to the cylindrical housing. The piston sleeve has an annular flange which is captured between the cylindrical housing and the cylinder head. Together, the piston head, piston sleeve, and cylinder head make a combustion chamber.

The cylinder head has an enclosed volume containing a valve train. The valve train components in the enclosed cylinder head volume are tappets, valve springs, cam bearings, a camshaft with a toothed cogwheel, a cam drive shaft with a worm at both ends, and bearing caps. The exhaust valve and intake valve are seated to the surface of the cylinder head disposed towards the housing. The enclosed cylinder head volume is sealed by a valve cap.

The rotating cylindrical hub has an edge disposed towards the cylinder head and an edge disposed towards the rear cover. An annular drive wheel is attached to the edge of the rotating cylindrical hub disposed towards the cylinder head.

The two half-cylindrical, helical grooves are oriented so that the two-piece cylindrical sleeve, and, therefore, the drive shaft, are rotationally powered in the same rotational direction both when the piston moves away from the cylinder head and into the two-piece cylindrical sleeve; and when the piston moves towards the cylinder head and away from the two-piece cylindrical sleeve.

When the piston is moving into the two-piece cylindrical sleeve, the follower exerts force on the lower piece of the cylindrical sleeve. When the piston is moving out of the two-piece cylindrical sleeve, the follower exerts force on the upper piece of the cylindrical sleeve. When the piston transitions from moving into the two-piece cylindrical sleeve to moving out of the two-piece cylindrical sleeve, the follower transitions from one of the half-cylindrical, helical grooves to the other half-cylindrical, helical grooves.

The cam drive shaft worm is geared to the outer periphery of the drive wheel. As the drive wheel rotates, it rotates the cam drive shaft worm, which rotates the camshaft. The camshaft has cams which actuate the tappets, opening and closing the exhaust and intake valve.

The rotating hub, two-piece cylindrical sleeve, and drive wheel are fixed relative to one another. By gearing the valve train to the drive wheel, and fixing the drive wheel to the rotating hub, and two-piece cylindrical sleeve, the Helical Follower Internal Combustion Engine prevents the piston from rotating.

In alternative embodiments, alternative anti-rotation features can be used. For example, the present invention can be fitted with a separate cylindrical anti-rotation sleeve, in order to prevent rotation. Such a cylindrical anti-rotation sleeve has a cut-out section and is used with a reciprocating block and counter-balance. The reciprocating block bolts to the piston rod, and extends out of the cut-out in the anti-rotation sleeve. A variety of plates and spacers are, also, used.

The present invention can be implemented with both a two-stroke and four-stroke cycle. In a four-stroke implementation, as the rotating hub, two-piece cylindrical sleeve, and drive wheel make two revolutions, the cam drive shaft makes one revolution. In a two-stroke implementation, as the rotating hub, two-piece cylindrical sleeve, and drive wheel make one revolutions, the cam drive shaft makes one revolution.

The present invention can be used to create electricity by attaching a rotor coil to the rotating cylindrical hub and attaching a stator coil to the rear cover. Electricity can then be accessed from the stator coil.

BRIEF DESCRIPTION OF THE DRAWINGS

The present invention is illustrated with 14 drawings on 9 sheets.

DETAILED DESCRIPTION OF THE DRAWINGS

The following descriptions are not meant to limit the invention, but rather to add to the summary of invention, and illustrate the present invention, a Helical Follower Internal Combustion Engine, by offering and illustrating various embodiments. While embodiments of the invention are illustrated and described, the embodiments herein do not represent all possible forms of the invention. Rather, the descriptions, illustrations, and embodiments are intended to teach and inform without limiting the scope of the invention.

Figure 3:
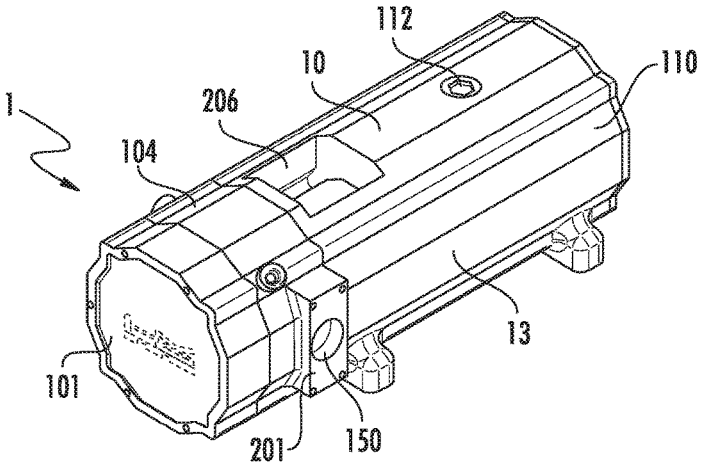
FIG. 3 is an isometric view of a Helical Follower Internal Combustion Engine.
Figure 4:
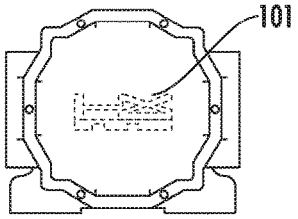
FIG. 4 is an end view of a Helical Follower Internal Combustion Engine.

FIGS. 3-9 show the present invention, a Helical Follower Internal Combustion Engine 1, from various views. FIG. 3 shows an isometric view of the Helical Follower Internal Combustion Engine 1 in a sealed condition. Visible in this view are the valve cap 101, housing 110, and the cylinder head 104. The housing 110 has a right side 13 and top surface 10. The exterior of the cylinder head 104 has a fuel injector or carburetor mount 201. In the center of the fuel injector or carburetor mount 201 is the intake hole and manifold 150. On the top surface 10 of the housing 110 is an access port 206. FIG. 4 is an end view of the valve cap 101.

Figure 5:
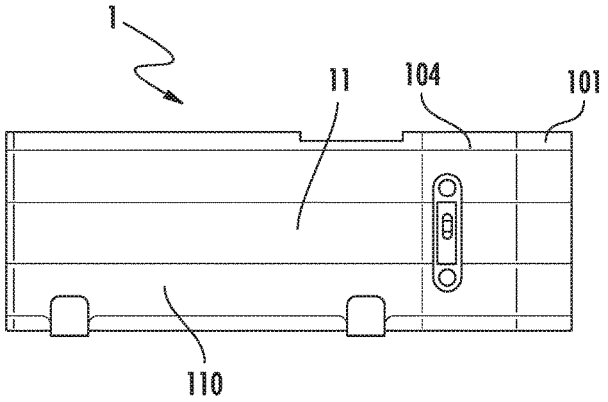
FIG. 5 is a lateral view of a Helical Follower Internal Combustion Engine.
Figure 6:
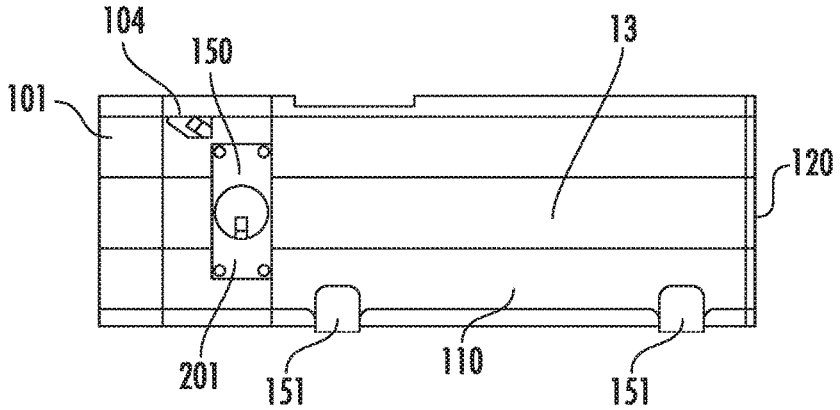
FIG. 6 is a reverse lateral view of a Helical Follower Internal Combustion Engine.
Figure 7:
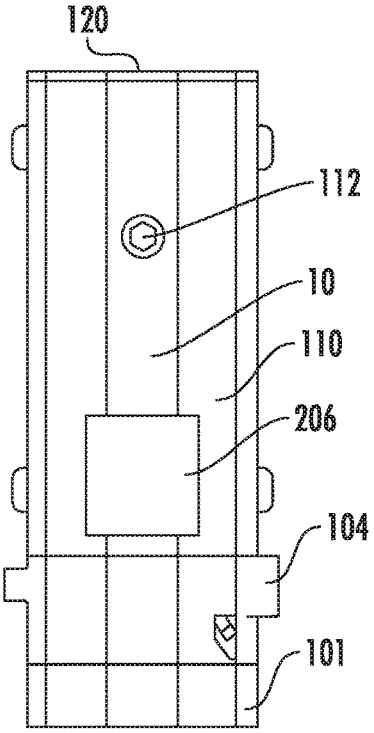
FIG. 7 is a top view of a Helical Follower Internal Combustion Engine.
Figure 8:
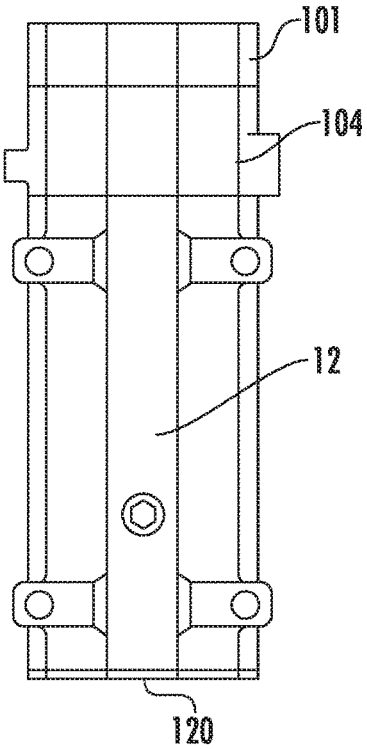
FIG. 8 is a bottom view of Helical Follower Internal Combustion Engine.
Figure 9:
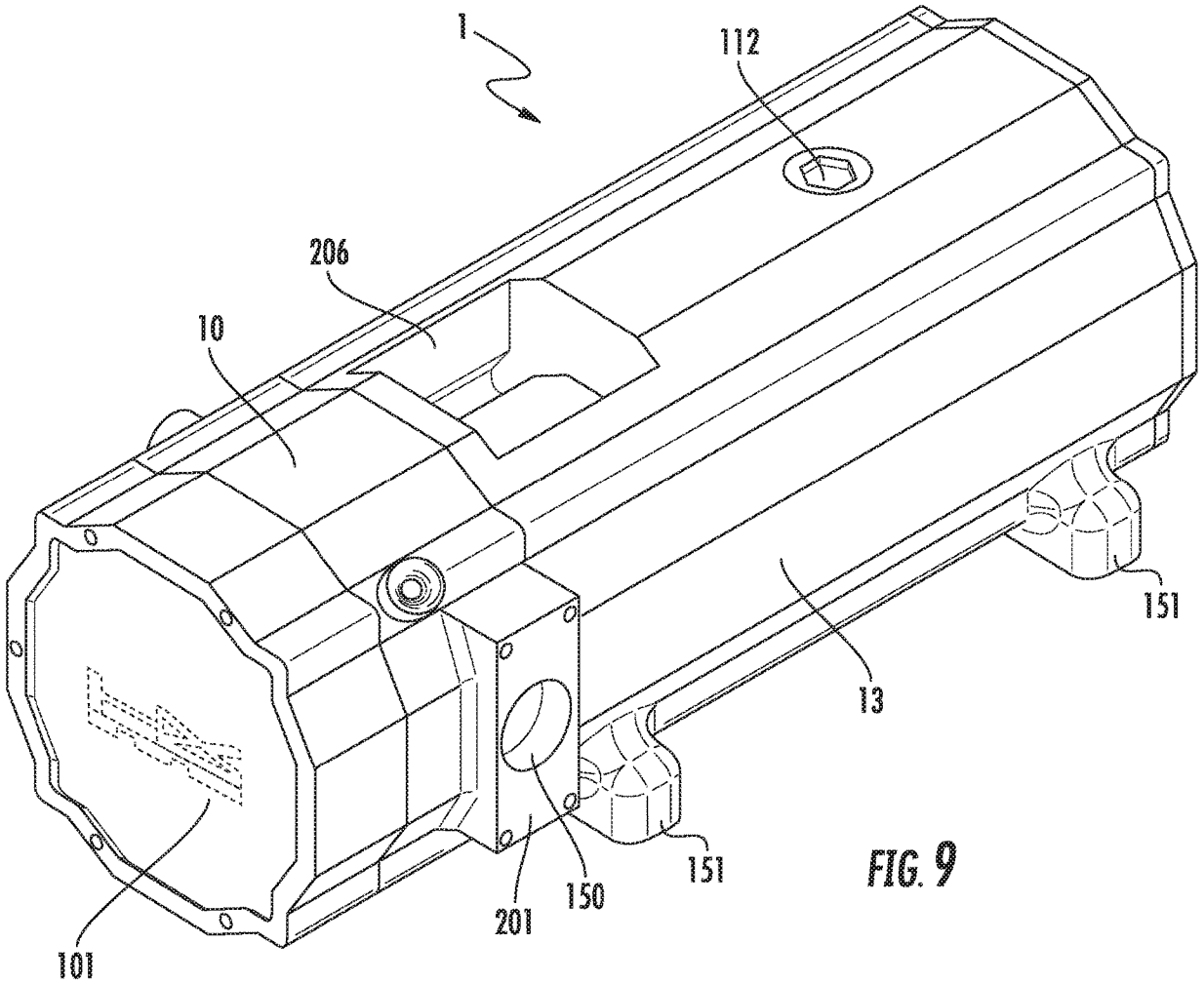
FIG. 9 is a large isometric view of a Helical Follower Internal Combustion Engine.

FIG. 5 shows a lateral view of the Helical Follower Internal Combustion Engine 1; FIG. 6 shows a reverse lateral view of the Helical Follower Internal Combustion Engine 1. In FIG. 5, the left side 11 of the housing 110 is visible, along with the cylinder head 104 and valve cap 101. In FIG. 6, the right side 13 of the housing 110 is visible, along with the cylinder head 104, valve cap 101, and rear cover 120. FIG. 6 also shows the intake hole and manifold 150, fuel injector or carburetor mount 201. The housing 110 has support feet 151 to support the Helical Follower Internal Combustion Engine 1, when it's on a flat surface. FIG. 7 is a top view of the Helical Follower Internal Combustion Engine 1 showing the top surface 10, the access port 260, and access nut 112. The valve cap 101, cylinder head 104, housing 110, and rear cover are visible external components. FIG. 8 shows the bottom of the Helical Follower Internal Combustion Engine 1 showing valve cap 101, cylinder head 104, rear cover 120, and the bottom surface 12 of the housing 110. FIG. 9 shows a large isometric view of the Helical Follower Internal Combustion Engine 1. Visible are the valve cap 101, cylinder head 104, housing 110, rear cover 120, access nut 112, right side 13 of the housing 110, top surface 10 of the housing 110, intake hole and manifold 150, access port 206, fuel injector or carburetor mount 201, and support feet 151.

Figure 1:
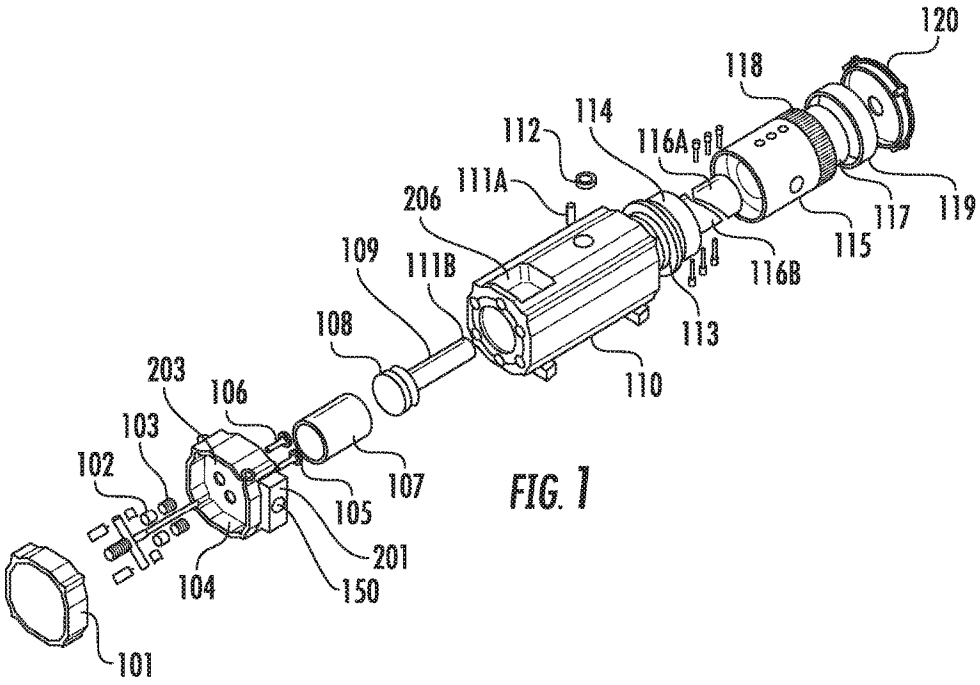
FIG. 1 is an exploded isometric view of a Helical Follower Internal Combustion Engine.
Figure 2A:
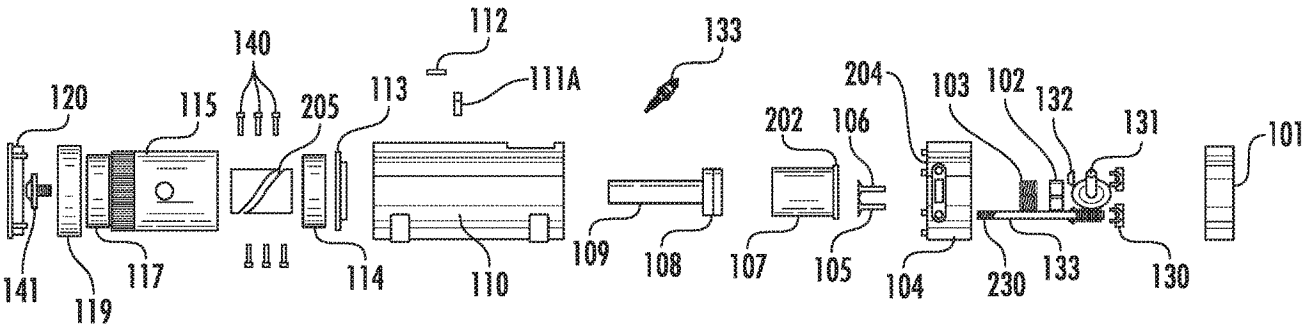
FIG. 2A is lateral exploded of the present invention, a Helical Follower Internal Combustion Engine.

FIG. 1 is an exploded isometric drawing of the present invention, a Helical Follower Internal Combustion Engine 1, showing its internal components. FIG. 2A is an exploded side view of the present invention, a Helical Follower Internal Combustion Engine 1, showing its internal components.

The valve cap 101 covers the cylinder head 104. The cylinder head 104 has a surface with a peripheral wall 203 disposed towards the valve cover 101, and a surface 204 disposed towards the housing 110. Internal to the cylinder head 104 are tappets 102, valve springs 103, cam bearing 132, camshaft 131, cam drive shaft 133, and bearing caps 130. The exhaust valve 106 and intake valve 105 are seated to surface 204 of the cylinder head 104 disposed towards the housing 110. A fuel and air mixture enters the cylinder head 104 through the intake hole and manifold 150. A fuel injector or carburetor is mounted on the fuel injector or carburetor mount 201.

The Helical Follower Internal Combustion Engine 1 has a piston 108, 109 with a piston head 108 and a piston rod 109. A piston sleeve 107 surrounds the piston 108, 109, within the housing 110. The piston sleeve 107 has an annular flange 202. The cylinder head 104 mates with the housing 110. The piston sleeve 107 annular flange 202 is fixed between the housing 110 and the cylinder head 104. Together, the piston head 108, piston sleeve 107, and cylinder head 104 make a combustion chamber. A spark plug 133 fits into an access port 206 in the housing 110, allowing it to spark into the combustion chamber 104, 108, 107.

The piston rod 109 has a machined hole 111B into which a follower 111A fits. The follower 111A is smooth, cylindrical, and orthogonal to the piston rod 109. The access nut 112 fits into the housing 110, allowing access to the follower 111A. The piston rod 109 fits through a drive wheel 113 and an annular bearing 114.

The Helical Follower Internal Combustion Engine has a rotating cylindrical hub 115. The rotating cylindrical hub 115 is bolted to a two-piece cylindrical sleeve 116A, 116B with a plurality of fasteners 140. In the present embodiment, attached to the bottom of the rotating cylindrical hub 115 is an optional rotor coil 118. An optional stator coil 119 is mounted to the bottom of the Helical Follower Internal Combustion Engine 1 at the rear cover 120. An annular bearing 117 allows the rotating cylindrical hub 115 to freely rotate. A rear cover 120 is held in place with a fastener 141.

Figure 2B:
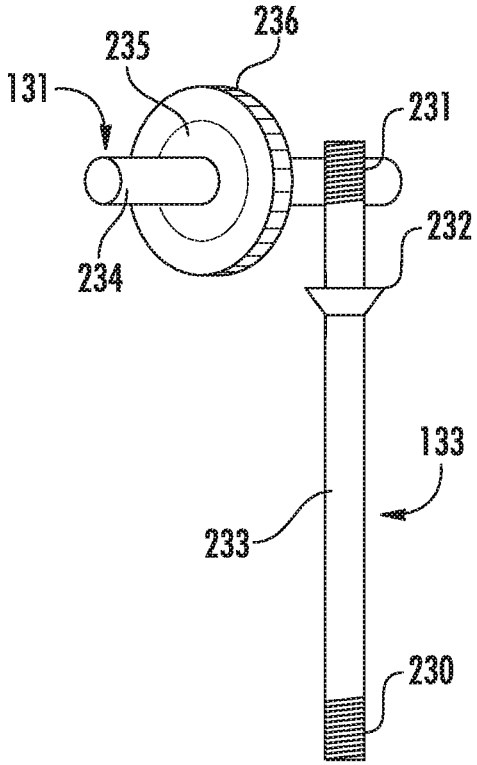
FIG. 2B is an isolation of the cam drive shaft and cam shaft.

In FIG. 2B is an isolation of the cam drive shaft 133 and camshaft 131. The cam drive shaft 133 has a top worm 231, a shaft 233, a lower worm 230, and a protrusion 232. The camshaft 131 has a shaft 234 and a cogwheel 235 with teeth 236. The teeth 236 of the cogwheel 235 mate with the orthogonal top worm 231 of the cam drive shaft 133. When the cam drive shaft 133 rotates, it causes the camshaft 131 to rotate.

Figure 10:
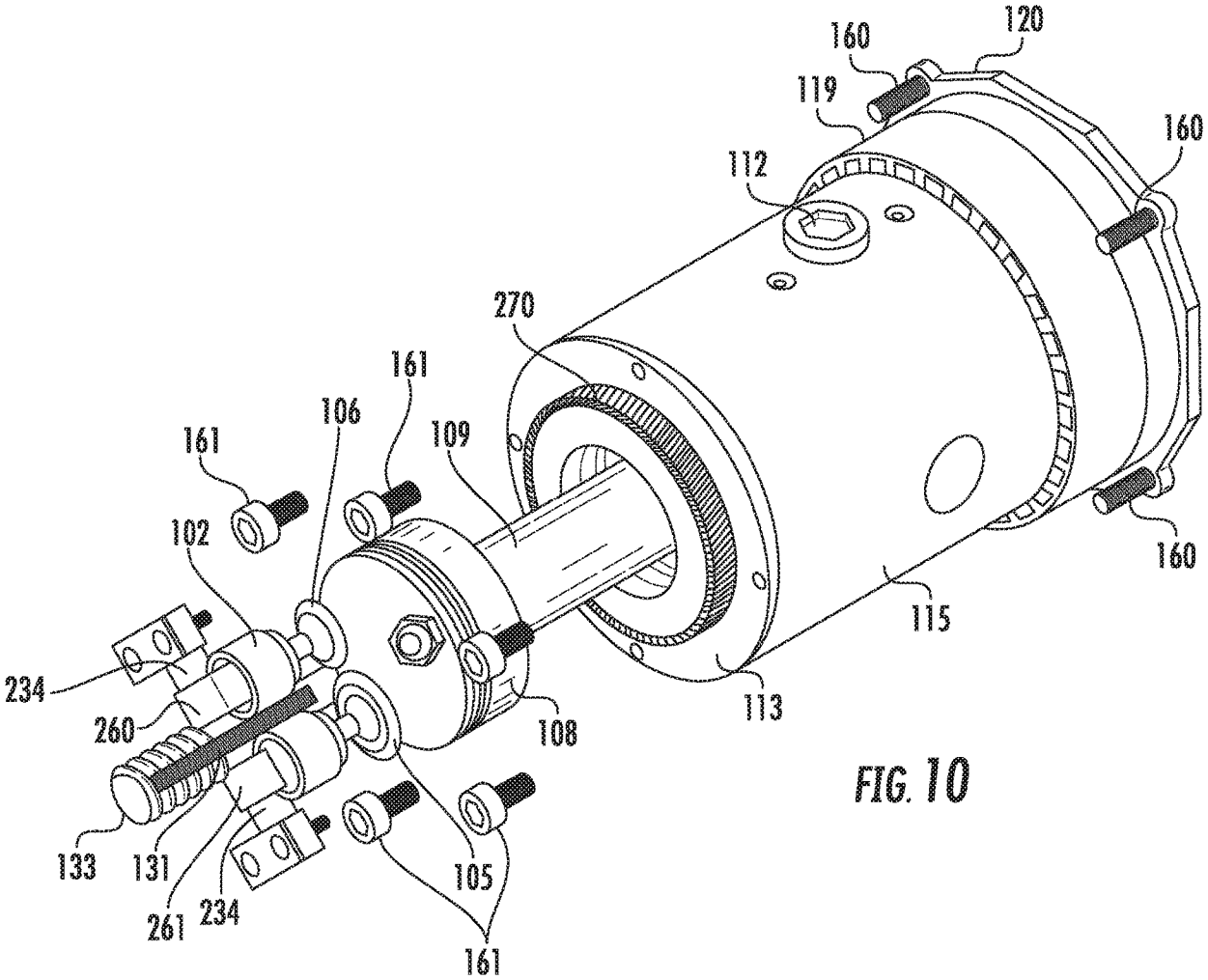
FIG. 10 is an isometric view of a Helical Follower Internal Combustion Engine with the valve cap, cylinder head and housing removed.

FIG. 10 shows the Helical Follower Internal Combustion Engine 1 with the valve cap 101, cylinder head 104, and housing removed 110. The rear cover 120 is held to the housing 110 with a plurality of fasteners 160. The optional stator coil 119 fits around the bottom of the rotating cylindrical hub 115. The annular drive wheel 113 fits over the top of the rotating cylindrical hub 115. The periphery of the annular drive wheel 113 has gear teeth 270 that mate with the lower worm 230 of the cam drive shaft 133. The piston rod 109 fits through the annular drive wheel 113. The piston head 108 is attached to the piston rod 109. Visible are the plurality of fasteners 161 that hold the cylinder head 104 to the housing 110. Many of the moving and timing components of the valve train are visible: tappets 102, camshaft 131, cam drive shaft 133, bearing cap 130, exhaust valve 106 and intake valve 105. The annular drive wheel 113 rotates, rotating the cam drive shaft 133. The cam drive shaft 133 rotates the camshaft 131. The camshaft 131 shaft 234 is held in place, while rotating, by the bearing caps 130 and cam bearing 132. Two cams 260, 261 are fastened to the camshaft 131 shaft 234. As the camshaft 131 is rotated, the cams 260, 261 raise and lower the tappets 102, opening and closing the intake valve 105 and exhaust valve 106.

Figure 11:
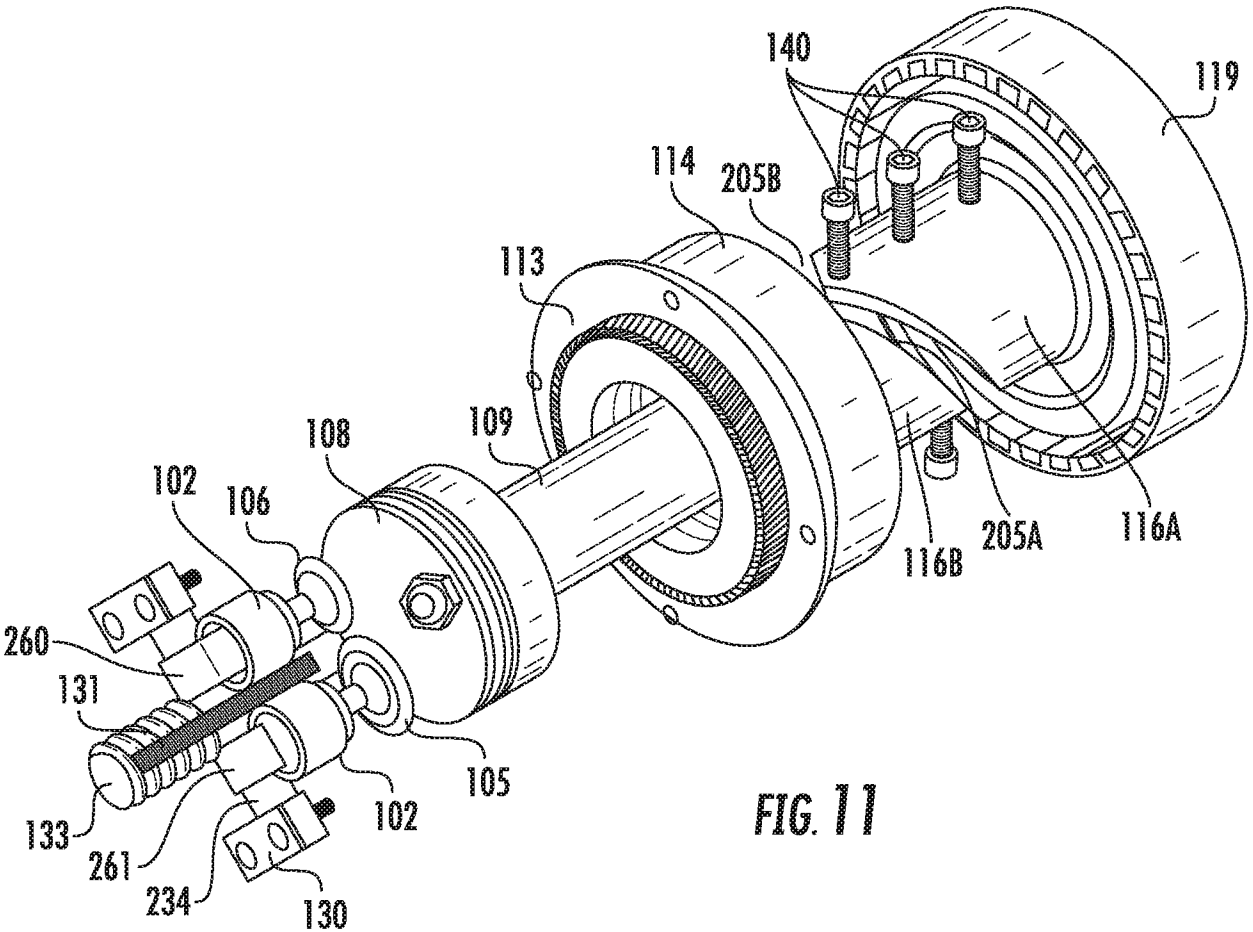
FIG. 11 is an isometric view of a Helical Follower Internal Combustion Engine with the valve cap, cylinder head, housing, rotating cylindrical hub and rotor coil removed.

FIG. 11 is FIG. 10 with the rotating hub 115, access nut 112, rear cover 120, and assorted fasteners 160, 161 removed. Still visible are various components of the valve train: tappets 102, camshaft 131, camshaft shaft 234, camshaft cams 260, 261, cam drive shaft 133, bearing cap 130, exhaust valve 106 and intake valve 105. The piston rod 109 extends through the annular drive wheel 113 and annular bearing 114. The two-piece cylindrical sleeve 116A, 116B is visible, as are the plurality of fasteners 140 which connect it to the rotating cylindrical hub 115. The two-piece cylindrical sleeve 116A, 116B forms two half-cylindrical helical grooves 205A, 205B.

Figure 12:
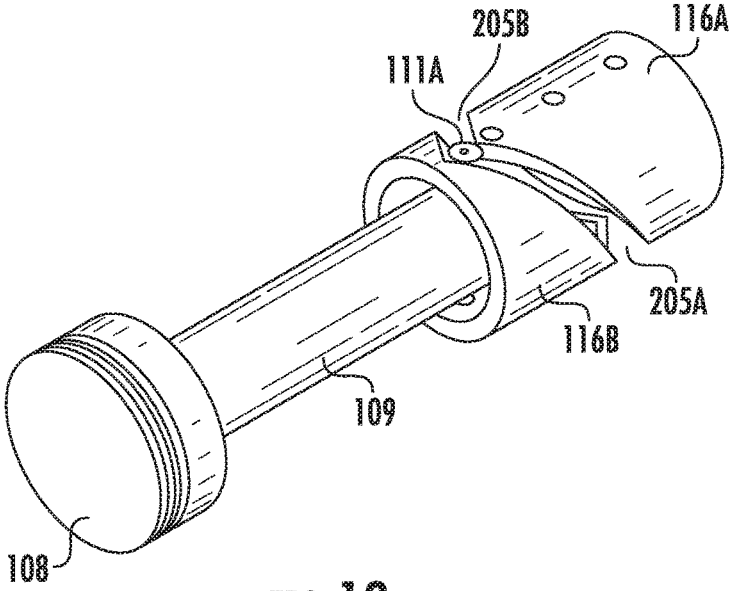
FIG. 12 is an isolation isometric of the piston, two-piece cylindrical sleeve, and follower.
Figure 13:
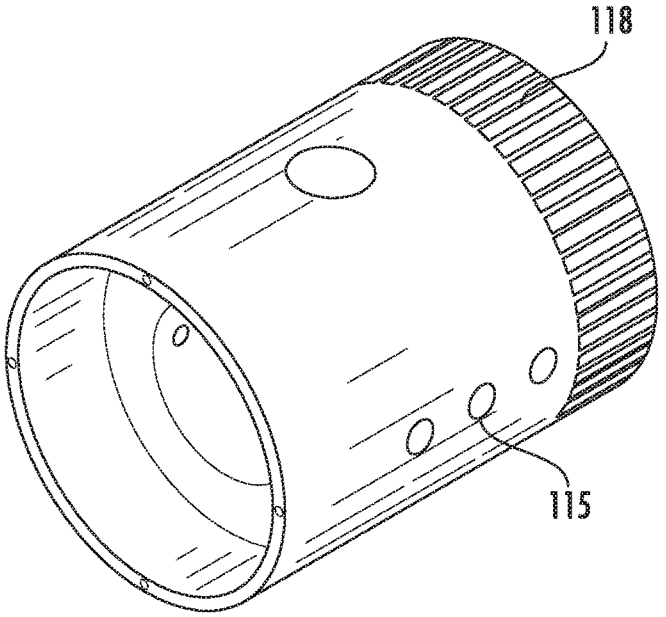
FIG. 13 is an isolation isometric of the rotating cylindrical hub and optional rotating coil.

FIG. 12 is an isolation of the piston 108, 109, two-piece cylindrical sleeve 116A, 116B, follower 114A, and the two half-cylindrical helical grooves 205A, 205B. FIG. 13 is an isolation of the rotating cylindrical hub 115 with rotor coil 118. The follower 114A fits in the two half-cylindrical helical grooves 205A, 205B. As the piston 108, 109 moves into the two-piece cylindrical sleeve 116A, 116B, the follower presses against the lower cylindrical sleeve 116A, rotating the two-piece cylindrical sleeve 116A, 116B, and the rotating hub 115 180°. As the piston 108, 109 moves out of the two-piece cylindrical sleeve 116A, 116B, the follower presses against the upper cylindrical sleeve 116B, rotating the two-piece cylindrical sleeve 116A, 116B, and the rotating cylindrical hub 115 an additional 180°. As the piston 108, 109 transitions from moving into the two-piece cylindrical sleeve 116A, 116B, to moving out of it, the follower transitions from one half cylindrical helical groove (e.g., 205A) to the other half cylindrical helical groove (e.g., 205B). The two-piece cylindrical sleeve 116A, 116B, and rotating cylindrical hub 115 rotate 720°, or two complete revolutions, for every four-stroke cycle of the piston 108, 109. The drive wheel 113 is geared to rotate the cam drive shaft 133 once for every two revolutions of the drive wheel 113. By connecting the drive wheel 113 to the two-piece cylindrical sleeve 116A, 116B, and the rotating hub 115, and by gearing the drive wheel 113 to the valve train 105, 106, 131, 133, 130, 102, 260, 261, 103, 132, through the cam drive shaft 133, the Helical Follower Internal Combustion Engine 1 keeps the piston 108, 109 from rotating.

Figure 14:
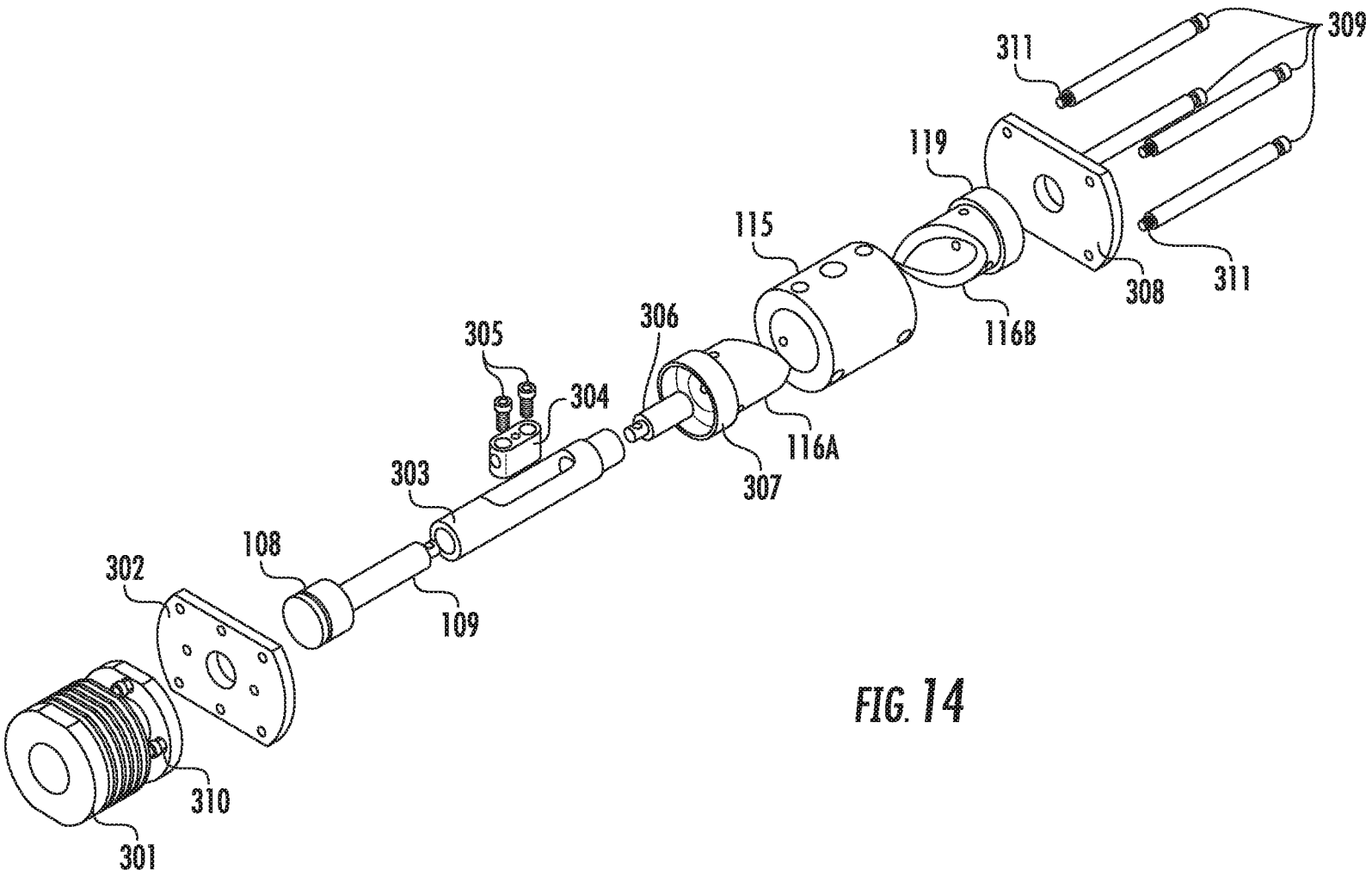
FIG. 14 is an exploded isometric view of an anti-rotation feature employed with the present invention.

FIG. 14 shows an alternative embodiment of an anti-rotation feature. The piston head 108, piston rod 109, two-piece cylindrical sleeve 116A, 116B, and rotating cylindrical hub 115 are shown in isolation. The piston rod 109 fits in a cylindrical anti-rotation sleeve 303, which has a cut-out or window. The piston rod 109 is connected to a reciprocating block 304 with fasteners 305. The reciprocating block 304 fits into the cut-out or window in the cylindrical anti-rotation sleeve 303, and extends past the surface of the cylindrical anti-rotation sleeve 303. The piston 108, 109 can reciprocate within the cylindrical anti-rotation sleeve 303 without rotating, due to the reciprocating block 304. The anti-rotation feature employs a counter-balance 306 to prevent undue mechanical vibration due to the cylindrical anti-rotation sleeve 303 and reciprocating block 304. A plurality of spacers 309 span the gap between the rear plate 308 and the flex plate 302, and connects to the front plate 301 with a plurality of screws 311 and screw caps 310. A modified drive wheel 307 with no gear teeth is used. In the version shown, an optional stator coil 119 is visible.

An alternative embodiment of the Helical Follower Internal Combustion Engine 1, the optional rotator coil 118 and stator coil 119 are removed, allowing the rotating cylindrical hub 115 to drive an external drive shaft.

In another alternative embodiment of the Helical Follower Internal Combustion Engine 1, a two-stroke cycle is utilized. The primary difference in using a two-stroke cycle is that the drive wheel 113 and cam drive shaft 133 rotate in unison. That is, the drive wheel 113 and cam drive shaft 133 rotation ratio is 1:1.

We claim:

1. A helical follower internal combustion engine comprising;

a piston in a combustion chamber, wherein the piston has a piston head and a piston rod, wherein a fuel-air mixture is capable of moving the piston in a reciprocal motion; and wherein the piston rod has a hole into which is seated and fixed a smooth, cylindrical follower that is orthogonal to the piston rod;

a rotating cylindrical hub into which the piston rod extends and to which a rotor coil is attached;

a stator coil from which electrical output can be drawn when the rotor coil is rotating;

a two-piece cylindrical sleeve, comprised of an upper piece and a lower piece, fastened externally to the rotating cylindrical hub, wherein the two-piece cylindrical sleeve has two half-cylindrical, helical grooves; and an anti-rotation feature that prevents the piston from rotating;

wherein the follower fits in the two-half cylindrical, helical grooves.

2. The helical follower internal combustion engine of claim 1, wherein the follower pushes on the lower piece of the two-piece cylindrical sleeve when the piston head moves towards the rotating cylindrical hub, causing the rotating cylindrical hub to rotate.

3. The helical follower internal combustion engine of claim 1, wherein the follower pushes the upper piece of the two-piece cylindrical sleeve when the piston head is moving away from the rotating cylindrical hub, causing the rotating cylindrical hub to rotate.

4. The helical follower internal combustion engine of claim 1, wherein the combustion chamber is formed by a cylinder head, a cylinder sleeve with an annular flange, and the piston head, wherein the piston head reciprocates within the cylinder sleeve with an annular flange.

5. The helical follower internal combustion engine of claim 4, wherein the cylinder head has a surface disposed towards the piston and surface which is disposed away from the piston, and wherein the surface disposed away from the piston has a peripheral wall.

6. The helical follower internal combustion engine of claim 5 further comprising; a valve train, wherein the valve train has a camshaft, a cam drive shaft, and a plurality of tappets, valve springs, valves, cam bearings, and bearing caps, wherein the valves seat against the surface of the cylinder head disposed towards the piston, with the shafts extending orthogonally through the surface of the cylinder head; and wherein the camshaft, tappets, valve springs, cam bearings, and bearing caps are all situated within the peripheral wall of the cylinder head.

7. The helical follower internal combustion engine of claim 6; further comprising; a valve cover that mates to the peripheral wall of the cylinder head.

8. The helical follower internal combustion engine of claim 7; further comprising a drive wheel with peripheral gear teeth, fastened to the peripheral edge of the rotating cylindrical hub that is disposed towards the piston.

9. The helical follower internal combustion engine of claim 8, wherein the cam drive shaft has an upper worm and a lower worm; the camshaft has a cogwheel centered on, and orthogonal to, a shaft; and the camshaft shaft has two cams attached to it;

wherein the lower worm of the cam drive shaft meshes with the peripheral gear teeth so that the drive wheel rotates the cam drive shaft;

wherein the upper worm of the cam drive shaft meshes with the cogwheel of the camshaft so that the cam drive shaft rotates the camshaft; and wherein, once during reach camshaft rotation, for each valve, a cam actuates the tappet compressing the valve spring, opening the valve into the combustion chamber.

10. The helical follower internal combustion engine of claim 9, further comprising a housing, comprised of at least one cylindrical segment; and a rear cover;

wherein the piston, cylinder sleeve, drive wheel, rotating cylindrical hub, and two-piece cylindrical sleeve are all situated in the housing;

wherein the housing is fastened to the cylinder head, capturing and fixing the annular flange of the cylinder sleeve; and wherein the rear cover is fastened to the housing.

11. The helical follower internal combustion engine of claim 10; wherein the anti-rotation feature is implemented through the interaction of the follower, rotating cylindrical hub, two-piece cylindrical sleeve, drive wheel, and valve train, thereby preventsing the piston from rotating.

12. The helical follower internal combustion engine of claim 10; wherein the anti-rotation feature comprises an anti-rotation sleeve, with a cut-out, in which the piston rod can reciprocate;

a reciprocating block, connected to the piston rod, and extending past the surface of the anti-rotation sleeve through the cut-out; and an anti-vibration counter-balance.

13. The helical follower internal combustion engine of claim 10; wherein the piston operates on a four-stroke cycle.

14. The helical follower internal combustion engine of claim 13; wherein the drive wheel rotates twice for each rotation of the cam drive shaft.

15. The helical follower internal combustion engine of claim 10; wherein the piston operates on a two-stroke cycle.

16. The helical follower internal combustion engine of claim 15, wherein the drive wheel rotates once for each rotation of the cam drive shaft.

17. A helical follower internal combustion engine comprising;

a piston in a combustion chamber, wherein the piston has a piston head and a piston rod, wherein a fuel-air mixture is capable of moving the piston in a reciprocal motion; and wherein the piston rod has a hole into which is seated and fixed a smooth, cylindrical follower that is orthogonal to the piston rod;

a rotating cylindrical hub into which the piston rod extends and to which an external drive shaft can be fixed;

a two-piece cylindrical sleeve, comprised of an upper piece and a lower piece, fastened externally to the rotating cylindrical hub, wherein the two-piece cylindrical sleeve has two half-cylindrical, helical grooves; and an anti-rotation feature that prevents the piston from rotating;

wherein the follower fits in the two-half cylindrical, helical grooves.

18. The helical follower internal combustion engine of claim 17, wherein the follower pushes on the lower piece of the two-piece cylindrical sleeve when the piston head moves towards the rotating cylindrical hub, causing the rotating cylindrical hub to rotate.

19. The helical follower internal combustion engine of claim 17, wherein the follower pushes the upper piece of the two-piece cylindrical sleeve when the piston head is moving away from the rotating cylindrical hub, causing the rotating cylindrical hub to rotate.

20. The helical follower internal combustion engine of claim 17, wherein the combustion chamber is formed by a cylinder head, a cylinder sleeve with an annular flange, and the piston head, wherein the piston head reciprocates within the cylinder sleeve with an annular flange.

21. The helical follower internal combustion engine of claim 20, wherein the cylinder head has a surface disposed towards the piston and surface which is disposed away from the piston, and wherein the surface disposed away from the piston has a peripheral wall.

22. The helical follower internal combustion engine of claim 21 further comprising; a valve train, wherein the valve train has a camshaft, a cam drive shaft, and a plurality of tappets, valve springs, valves, cam bearings, and bearing caps, wherein the valves seat against the surface of the cylinder head disposed towards the piston, with the shafts extending orthogonally through the surface of the cylinder head; and wherein the camshaft, tappets, valve springs, cam bearings, and bearing caps are all situated within the peripheral wall of the cylinder head.

23. The helical follower internal combustion engine of claim 22; further comprising; a valve cover that mates to the peripheral wall of the cylinder head.

24. The helical follower internal combustion engine of claim 23; further comprising a drive wheel with peripheral gear teeth, fastened to the peripheral edge of the rotating cylindrical hub that is disposed towards the piston.

25. The helical follower internal combustion engine of claim 24, wherein the cam drive shaft has an upper worm and a lower worm; the camshaft has a cogwheel centered on, and orthogonal to, a shaft; and the camshaft shaft has two cams attached to it;

wherein the lower worm of the cam drive shaft meshes with the peripheral gear teeth so that the drive wheel rotates the cam drive shaft;

wherein the upper worm of the cam drive shaft meshes with the cogwheel of the camshaft so that the cam drive shaft rotates the camshaft; and wherein, once during reach camshaft rotation, for each valve, a cam actuates the tappet compressing the valve spring, opening the valve into the combustion chamber.

26. The helical follower internal combustion engine of claim 25, further comprising a housing, comprised of at least one cylindrical segment; and a rear cover;

wherein the piston, cylinder sleeve, drive wheel, rotating cylindrical hub, and two-piece cylindrical sleeve are all situated in the housing;

wherein the housing is fastened to the cylinder head, capturing and fixing the annular flange of the cylinder sleeve; and wherein the rear cover is fastened to the housing.

27. The helical follower internal combustion engine of claim 26; wherein the anti-rotation feature is implemented through the interaction of the follower, rotating cylindrical hub, two-piece cylindrical sleeve, drive wheel, and valve train, thereby preventing the piston from rotating.

28. The helical follower internal combustion engine of claim 26; wherein the anti-rotation feature comprises an anti-rotation sleeve, with a cut-out, in which the piston rod can reciprocate;

a reciprocating block, connected to the piston rod, and extending past the surface of the anti-rotation sleeve through the cut-out; and an anti-vibration counter-balance.

29. The helical follower internal combustion engine of claim 26; wherein the piston operates on a four-stroke cycle.

30. The helical follower internal combustion engine of claim 29; wherein the drive wheel rotates twice for each rotation of the cam drive shaft.

31. The helical follower internal combustion engine of claim 26; wherein the piston operates on a two-stroke cycle.

32. The helical follower internal combustion engine of claim 31, wherein the drive wheel rotates once for each rotation of the cam drive shaft.

* * * * *